US005174085A

United States Patent [19]

Lu

[11] Patent Number: 5,174,085

[45] Date of Patent: Dec. 29, 1992

[54] METHOD OF ADDING ADDITIONAL STORIES TO AN EXISTING STORIED BUILDING

[75] Inventor: Jian-heng Lu, Guizhou Province, China

[73] Assignee: Chinese Building Technology Services Corp. Ltd., Kowloon, Hong Kong

[21] Appl. No.: 715,065

[22] Filed: Jun. 12, 1991

[51] Int. Cl.[5] ..... E04B 1/00; E04B 1/35

[52] U.S. Cl. ..... 52/741.1; 52/79.9; 52/79.12; 52/79.13; 52/236.3; 52/745.03

[58] Field of Search ..... 52/79.9, 79.12, 79.13, 52/79.14, 745, 747, 741, 236.3

[56] References Cited

U.S. PATENT DOCUMENTS 4,640,070 2/1987 Moffat ..... 52/741

FOREIGN PATENT DOCUMENTS 890803 8/1989 China ..... 52/741
9609 5/1991 China .
12214 12/1991 China .
1065558 1/1984 U.S.S.R. .
1255688 9/1986 U.S.S.R. .

OTHER PUBLICATIONS

"Reconstruction of Buildings", by Koutoukov, Moscow, 1981, pp. 240–247 and pp. 252–253.

*Primary Examiner*—Richard E. Chilcot, Jr.
*Assistant Examiner*—Wynn E. Wood
*Attorney, Agent, or Firm*—Armstrong & Kubovcik

[57] ABSTRACT

A designing and construction process for raising the height of old buildings suitable for use to raise the height of old buildings of 2–6 stories, or of 7–9 stories if necessary. With this method, it is possible to add 5–8 stories to the old building with no need to demolish the old building and to move the residents to other places. Owing to the employment of supporting frame structure, which is independent of and directional pivotally connected to the original building, the weight of the new building is not supported by the old building, and owing to the employment of shock absorbing devices for building and "shock isolator for buildings", the aseismic capacity of the building is greatly enhanced. This method of raising the height of low-storeyed building of the invention solves a number of problems in relation to rebuilding buildings and avoids great waste.

11 Claims, 7 Drawing Sheets

METHOD OF ADDING ADDITIONAL STORIES TO AN EXISTING STORIED BUILDING

BACKGROUND OF THE INVENTION

1. Field of the Invention

The invention relates to the construction area, particularly to the area where existing low-storied buildings are to be transformed into high-storied buildings, i.e., adding additional stories to existing low-storied buildings.

2. Description of Related Art

The addition of additional stories to existing low-storied buildings is a new theme in the development of urban construction all over the world. With the increase of urban populations, cities are bound to expand, but owing to the limitations of cultivated areas, the actual area of individual cities cannot be enlarged at will. It is therefor necessary to confine development to within the scope of the city proper. This requires raising the height of buildings in the city, especially where the original buildings are generally very low in height, where the contradiction between reality and requirement is most prominent. Up to now the solutions to this contradiction involve:

1. Demolishing the original low-storied buildings and reconstructing new high-storied buildings at the site. In so doing, not only do there arise the problems of moving residents to other places, as well as the disposal of waste from the construction site, but also that some of the buildings must be forced down notwithstanding the fact that they are far from service maturity. This causes extravagance and waste, as well as some social problems that are difficult to solve.

2. Raising the height of the original buildings.

At present, raising the height of buildings comprises mainly two processes:

a) The original building is retained, and one to two stories are added to it; and b) More stories are added by means of a pure frame structure.

In process a), the weight of the additional stories are to be supported by the original building structure. However, as the bearing capacity of the original building structure is quite limited, only one or two stories can be added at the most. Obviously, this cannot satisfy the requirement of raising the height of the buildings. In process b), the weight of the added stories cannot be transmitted to the foundation via the frame structure, because the frame structure has not taken into consideration in its design the precise route of force transmission of the added structure of the stories, i.e., there should be no confusion regarding the route of force transmission. In addition, no measure is taken to avoid sliding of the foundation, possibly occurring during an earthquake. Therefore, this kind of story-added structure not only presents intrinsic faults regarding the principle structural design mechanics, i.e., the confusion of the routes of force transmission of the structure, but also its earthquake resistance is very low.

The object of this invention is to provide a method for adding additional stories to an existing low-storied building for raising the height of the existing low-storied building, in which the weight of the newly-added multi-storied building portion is transmitted to the ground base via a weight supporting frame structure specifically connected to the original building, rather than supported by the original building, so that the routes of force transmission of the added integral structure, in any circumstance, (including earthquake, shock load) will not be confused. In the meantime, there are incorporated in this invention three items which are subjects of pending patent applications, namely, "Devices of Shock Resistance and Shock Absorbing for Buildings" (Chinese Patent Application No. 87100151); "Shock Isolator for Buildings" (Chinese Patent Application No. 88108470.0); and "Connectors Between New and Old Structures in Raising the Height of Old Buildings" (Chinese Patent Application No. 89106137.1) for realizing the above-mentioned specific connection. In addition, a stress superimposed area of the ground base is provided with an anti-slide plate, so that the aseismic capacity of the integral structure of the stories-added low-storied building is substantially increased.

The method according to the invention for accomplishing the above-mentioned objects is as follows.

Closely around the original building is laid a foundation upon which several story-adding supporting frame columns are erected. Structure expansion & contraction joints are provided between the original building and the columns and these joints can be filled with compressible material.

Story-adding frame supporting girders are fixedly connected with said frame columns above the roof of the original building so that the weight of the story-adding structure is to be supported by the girders and to be transmitted to the ground base via the frame columns. The bottom surface of the girder and the top surface of the original building are separated by a space, the dimension of which should be bigger than the amount of sinking of the story-adding structure.

The frame columns are connected at the floor place of every story of the original building to the columns of the original building by means of the connectors between new and old structures, as disclosed in Chinese Patent Application No. 89106137.1, assuming a connection by oriented pivotal bearing, for example, the end of the frame column being a fixed end while the end at the column of the old building a vertically movable hinge end, where sideways moving is not permitted.

Close at the outer side of the foundation of the story-adding supporting frame column and below the bottom of the foundation there is provided an anti-sliding plate for ground base soil, for example, using a reinforced concrete plate.

Between the foundation of the original building and the newly-added foundation of the supporting frame columns is provided a partition made of hard and thin material.

In order to enhance the stability of the newly added story-adding supporting frame columns, they are connected to each other lengthwise along the original building at the level of every corresponding floor place thereof by means of the plate beams.

It is understood that the structure of the original building is basically stable after many years of use, so that it may be deemed a non-deforming rigid body. The story-adding structure, at an early stage of use, may present sinking of foundation and self-deformation of the structure members after subjecting to load, resulting in a vertical relative displacement, between the new and old buildings. Consequently, if no appropriate measures are taken, or no specific connections are provided between the old and new buildings, but rather, a conventional rigid connection is still employed, the weight of the new building would surely press down on the old building resulting in a confusion of route of force transmission and the increase of stress within the old and new structures. However, as there is provided, according to the present invention, a certain space between the bottom surface of the story-adding frame supporting girders an the top surface of the original building, particularly as the connectors between new and old structures employed between the new and old buildings are oriented pivoted bearings, it not only can avoid the above-mentioned defects, but also can shorten the free length of the story-adding frame columns, enhance the stability of the story-added structure and the integrity with the old building so as to improve the aseismic capacity of the overall building.

Furthermore, as there is provided an anti-sliding plate for ground base soil as mentioned above, it can prevent the ground soil under the new building foundation from being squeezed out in a direction away from the original building, thus preventing the foundation from sliding. This also enhances the aseismic capacity of the building.

Besides, as the foundations of the old and new buildings are arranged close to each other, the span length of the girders are shortened, and as they are separated from each other by a partition, it can prevent the foundation of a new building from affecting the foundation of the original building before it reaches its stability.

The method, objects and advantages of the invention will now be described in detail by reference to the accompanying drawings, in which the same reference number will be applied to the same or corresponding part.

DESCRIPTION OF THE PREFERRED EMBODIMENTS

Figure 7A:
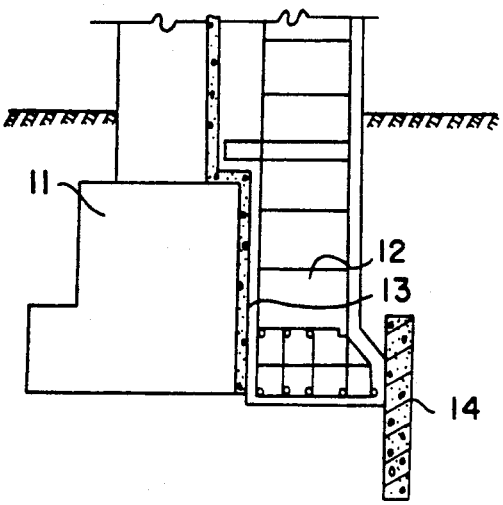
FIG. 7*a* is a schematic drawing showing the foundations of the new and old buildings, the partition between the two foundations and the anti-sliding plate for ground base soil, in which a part of the foundation of the old building has been cut off.
Figure 7B:
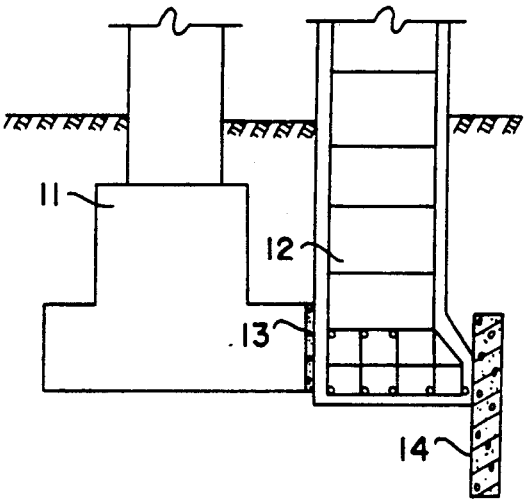
FIG. 7*b* is a schematic drawing showing the foundations the new and old buildings, the partition between the two foundations and the anti-sliding plate for ground base soil, in which the foundation of the old building retains its original shape.
Figure 11:
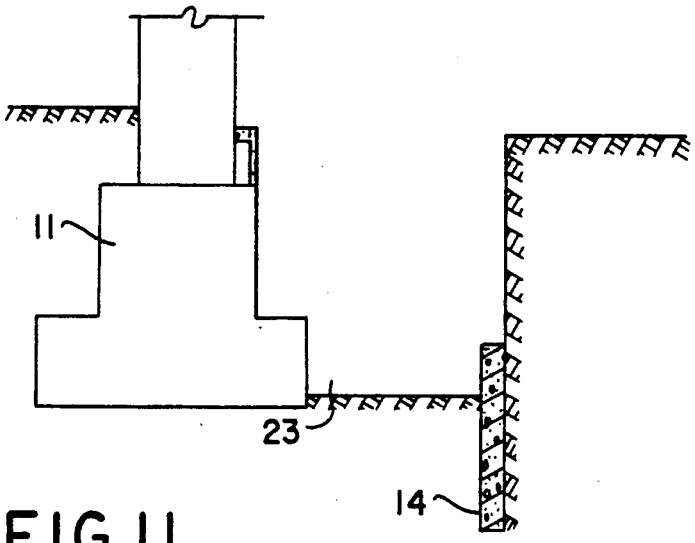
FIG. 11 shows the foundation of the original building and the anti-sliding plate for ground base soil installed at the outer side of the foundation of the story-adding frame structure and below the bottom of the foundation.

Referring to FIG. 7, in order to shorten the span length of the story-adding supporting girder, the foundation 12 of the new building should be as close to the foundation of the original building as possible. For this purpose, a part of the foundation 11 of the original building can be removed when it is not supporting foundation, as shown in FIG. 7*a*. To avoid the sinking of the foundation of the ne building at its initial stage of use, which may cause damage to the foundation of the original building, a partition 13 made of thin yet hard material is provided between the two foundations. In order to prevent the ground soil of the new building foundation from being squeezed out toward the side away from the original building, which causes the sliding of the foundation of the story-adding structure, an anti-sliding plate 14 for ground base soil is provided at the outer side of the story-adding structure and below the bottom of its foundation, as shown in FIGS. 7 and 11.

Figure 10A:
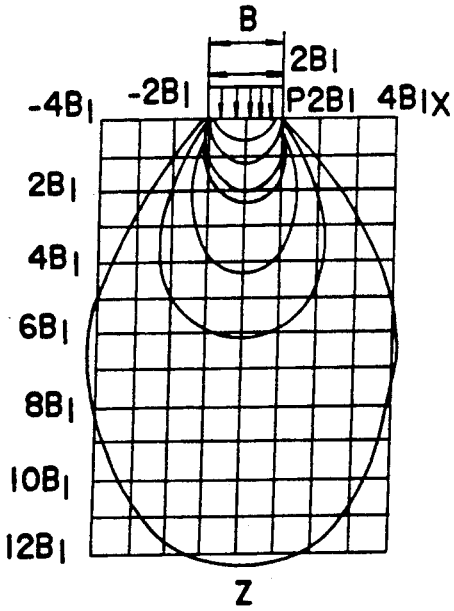
FIG. 10*a* is a compression stress distribution diagram of the stable foundation of the original building.
Figure 10B:
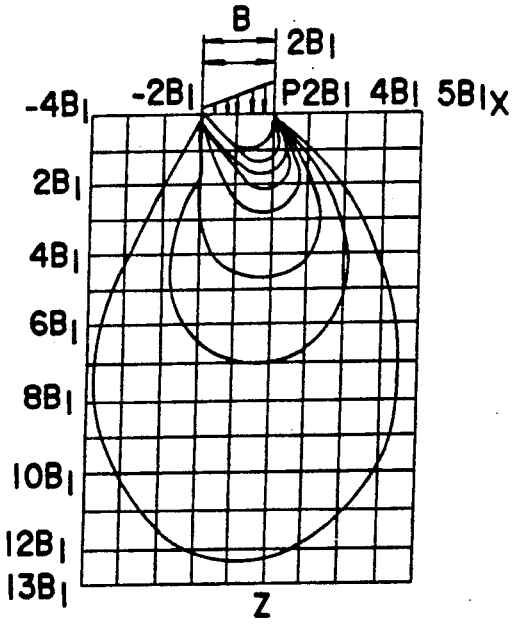
FIG. 10*b* is a compression stress distribution diagram of the story-adding frame structure after its foundation becomes stable under separate load.

For better understanding of the necessity of providing a anti-sliding plate 14 for ground base soil, a further description is made as follows. The foundation of the original building has typically become stable after many years of use, and its stress distribution is shown in FIG. 10*a*, while the foundation of the new building at its initial stage of use has not yet become stable, so when the two foundations are brought together acting with each other, the stress of the story-adding structure foundation would have little effect on the stress distribution of the original building foundation, whereas the counteraction created by the stress of the original building foundation acting on the stress transmitted from the story-adding structure foundation would alter the stress distribution of the story-adding structure when it acts separately. This alteration of the stress distribution would cause the ground soil under the foundation of the story-adding structure to be squeezed out to the side away from the original building foundation, or rather more is squeezed out in that direction. Although, be it a one directional squeeze out or a two directional one, there is no effect on the limiting load value, yet where the load is tremendously great, for example, during an earthquake, it will lead to a sliding of the foundation of the story-adding structure, and the sliding of the foundation will make the story-adding structure crack, twist or tilt. Therefore, at the outer side of the story-adding structure foundation and below the bottom of that foundation, an anti-sliding plate for ground base soil is provided, forming a confinement for this foundation to assure that the foundation will not likely be squeezed out sideways when the story-adding structure acting on the foundation, so as to avoid the occurrence of the above-mentioned harmful situation.

When the ground base is a rock bedding, it is better to adopt a isolated foundation under column. When the ground base is of a soil bedding, then it is better to adopt a reinforced concrete strip foundation. When the strip foundation under column cannot satisfy the requirement it is possible to supplement drilled piles or bored piles, but it is not allowed to employ driven piles. It should be noted that in case the underground water level is high, it is not permissible to employ the method of pumping away the underground water, although pumping away underground water is a convenient way for the construction of the foundation of the story-adding frame structure. As it is likely to alter the stress state of the ground base of the original building, it might adversely affect the story-adding overall structure. Under this circumstance it is better to employ the under water concreting method.

Figure 8:
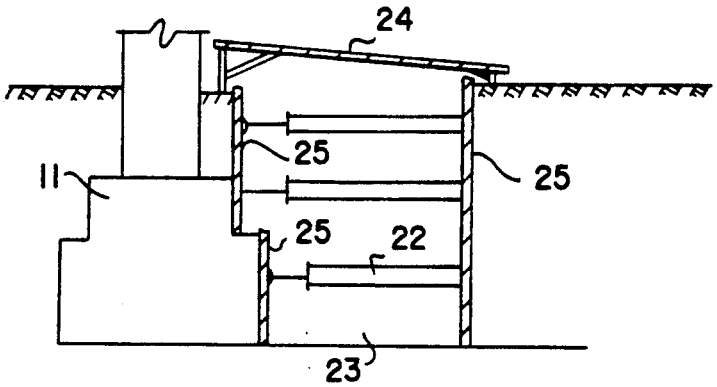
FIG. 8 is a schematic drawing showing the foundation of the original building and the sheet pile wall and the brace in the foundation ditch of the story-adding frame structure and the rain protection shelter, above the foundation ditch.

For construction of the foundation, it is preferable to adopt a segmentation construction method. After one segment is excavated and concreted, the next segment is started excavated and concreted and so on. In the excavated foundation pit, sheet pile walls 25 are supported by means of braces 22 against the foundation walls of the original building and the story-adding frame. During rainy season, rain protection shelters should be erected to prevent too much rainwater from flowing into the foundation pit 23, as shown in FIG. 8.

Figure 1B:
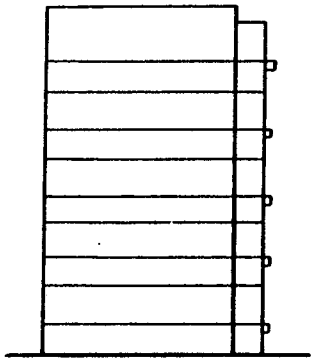
FIG. 1*b* is a side view of the original building.
Figure 1A:
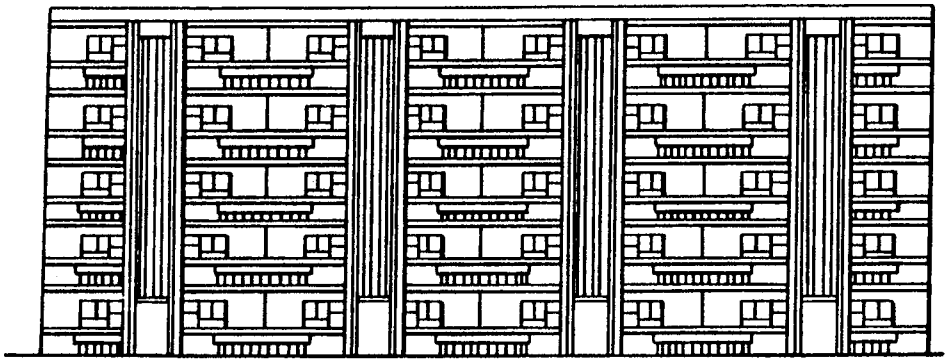
FIG. 1*a* is a front view of the original building.
Figure 2B:
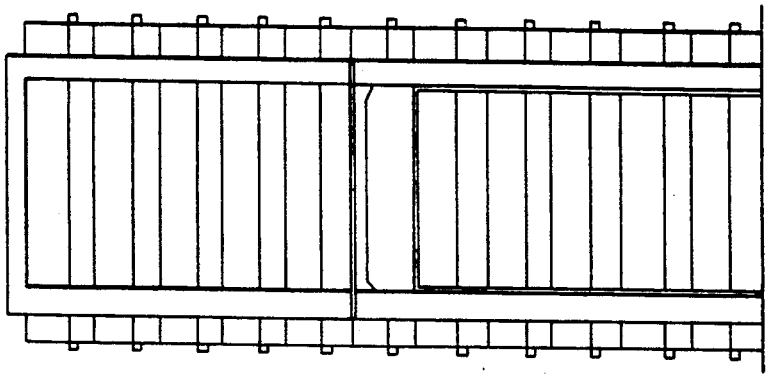
FIG. 2*b* is a side view of the story-added building according to the invention.
Figure 2A:
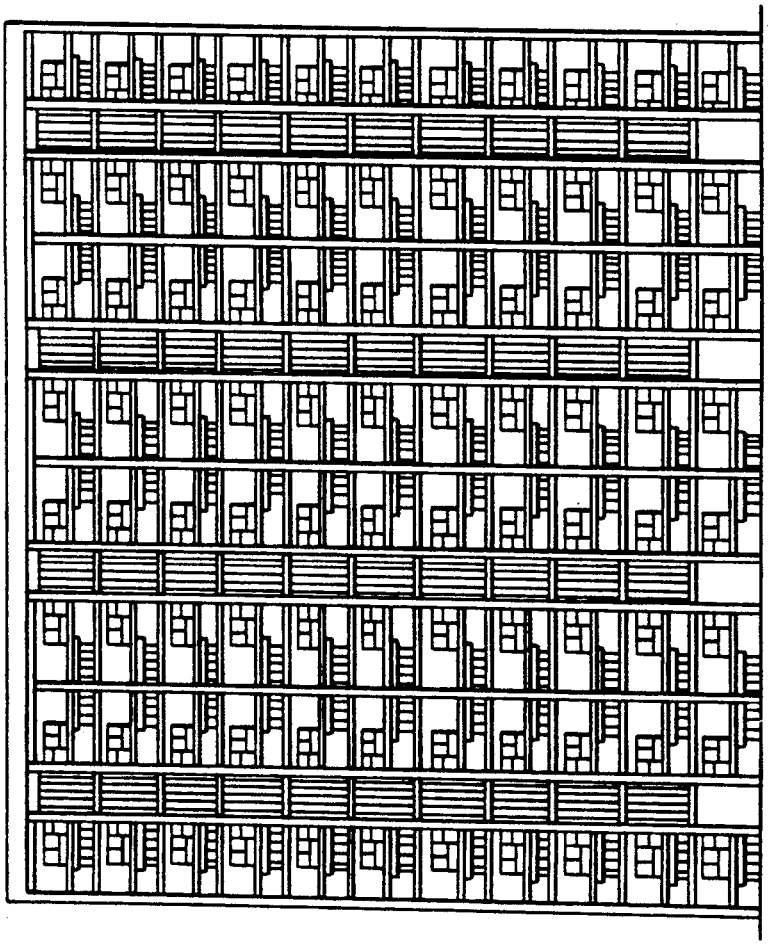
FIG. 2*a* is a front view of the story-added building according to the invention.
Figure 4:
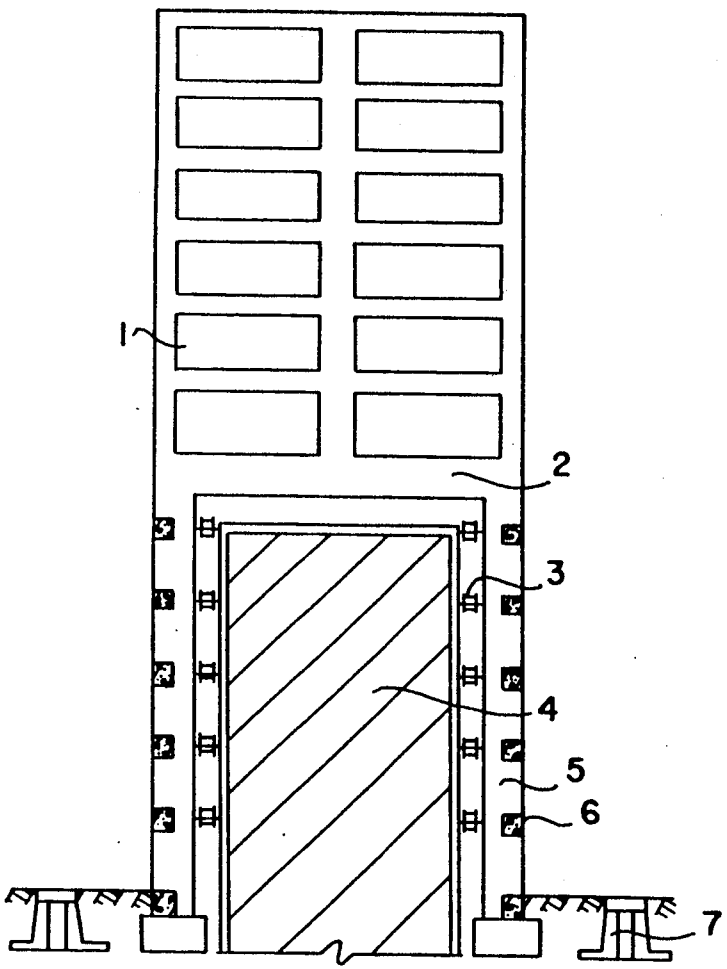
FIG. 4 is a schematic drawing showing the newly-added overall frame structure close around the original building with the building shock isolator means according to the invention.
Figure 3:
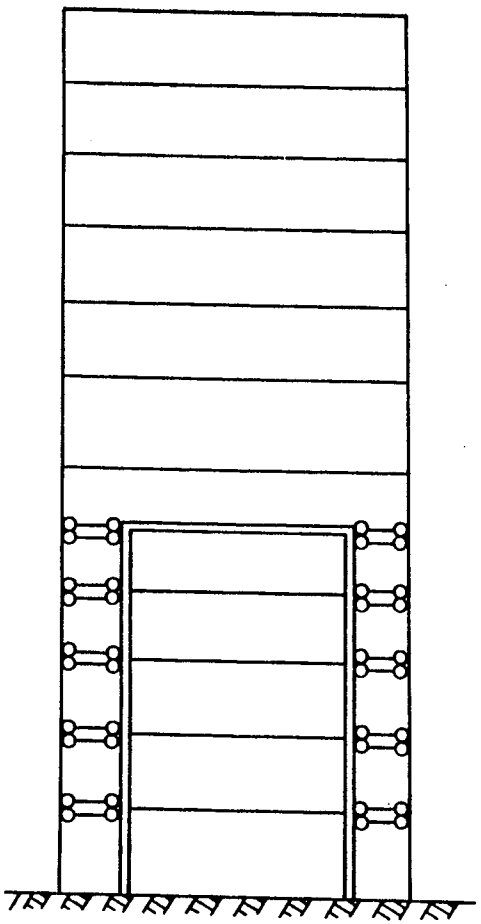
FIG. 3 is a schematic drawing for calculation of the structure of the invention.

FIG. 4 illustrates a preferred embodiment of the invention. On the foundation of the above-mentioned story-adding structure around the original building 4, are cast reinforced concrete columns 5 are cast, which form, with the upper story-adding structure 1, an integral structure. Above the top of the original building, the story-adding frame supporting girders 2 are rigidly connected with the above-mentioned frame columns, so that the weight of the story-adding structure is to be supported by the girder 2 and via the columns 5 transmitted to the ground base. Between the bottom surface of the girders 2 and the top surface of the original building 4 there exists a certain space or clearance, the dimension of which should be greater then the amount of sinking of the story-adding structure. To enhance the stability of the overall structure, it is necessary to connect the story-adding structure with the original building 4, but as the structure of the original building has been stable after many years of use, while the story-adding structure at an initial stage of use owing probably to the sinking of the foundation or self-deformation of some of its components when subject to load, has not yet been stable, if the two are made rigidly connected, it surely will cause a confusion of the route of force transmission, and deteriorate the stress state. To solve this problem, the frame columns 5 are connected at the floor place of every story of the original building 4 to the columns of the original building by means of the connectors between new and old structures, 3 assuming a connection by oriented pivotal bearing, for example, the end at the frame columns 5 being the fixed end and the end at the columns of the original building being the vertically movable hinge end where sideways movement is not allowed. To strengthen the stability of the story-adding supporting frame columns 5, they are lengthwise connected with each other by the plate beam 6 at the level of every corresponding floor of each story of the original building 4. To enhance the aseismic capacity of the story-adding integral structure, a shock insulator for a building, as disclosed in Chinese Patent Application No. 88108470.0, is provided at the outer side of the ground base.

Figure 5:
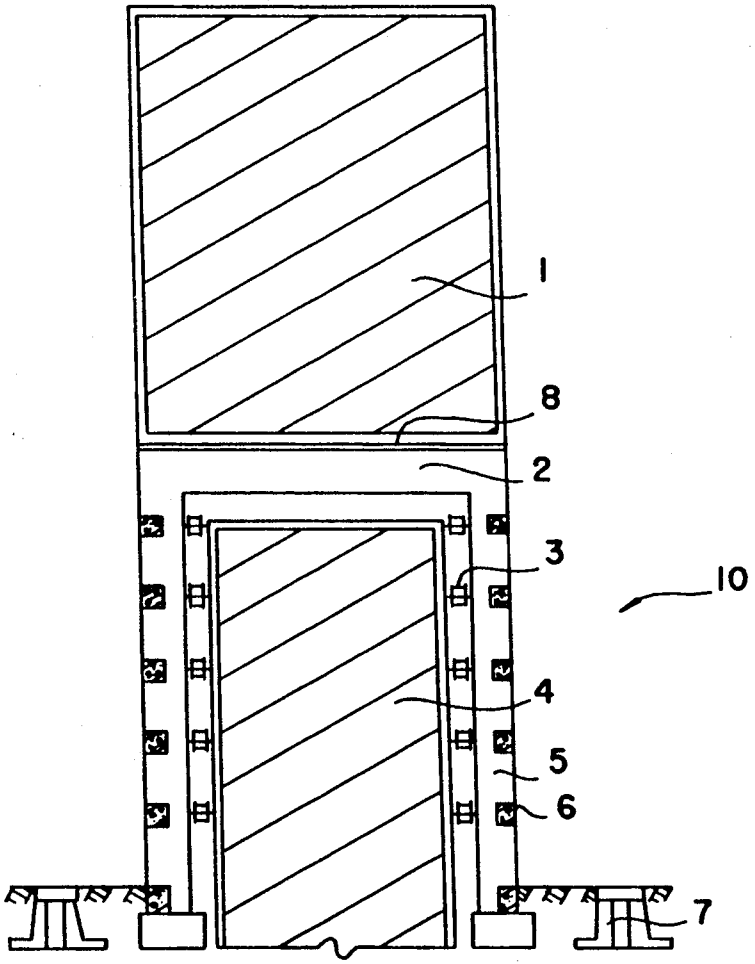
FIG. 5 is a schematic drawing showing the newly-added single-deck supporting frame close around the original building and the superimposed story-adding composite structure, including shock absorber devices of the prior art, according to the invention.

FIG. 5 shows another embodiment of the invention. The upper story-adding structure 1 is a composite structure, composed, for example, of bricks and concrete, which is separated from the lower single-deck supporting frame structure 10 (including column 5, girder 2, plate beam 6, and prior art connector between new and old structures 3) and is superimposed through the prior art shock absorbing devices 8 upon the lower single-deck supporting frame structure 10. In other respects this embodiment is the same as the embodiment shown in FIG. 4.

Figure 6:
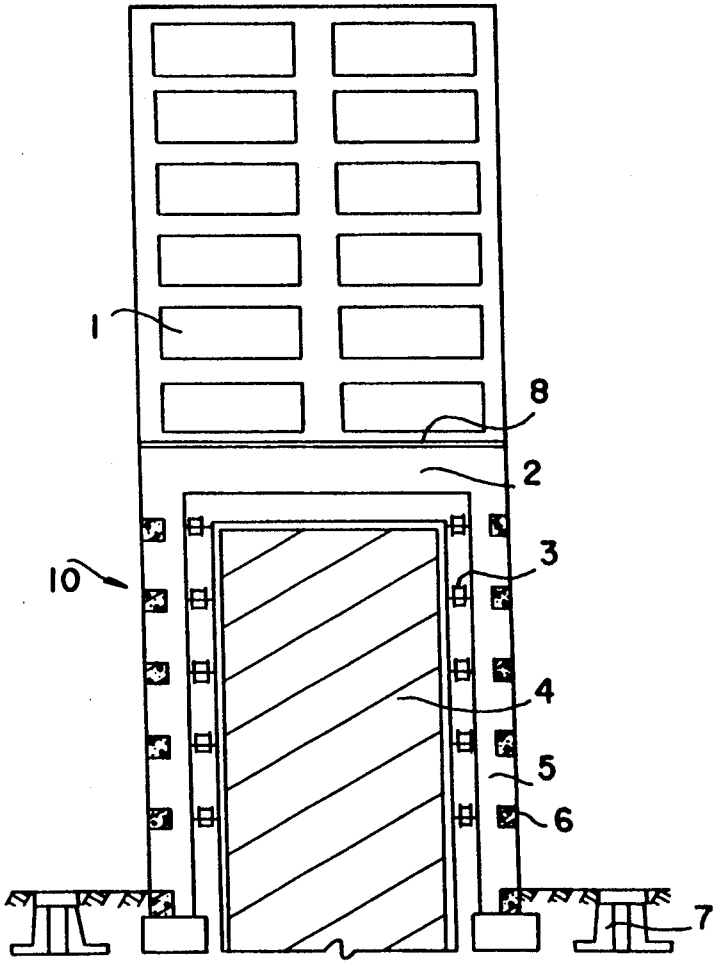
FIG. 6 is a schematic drawing showing the newly-added single-deck supporting frame close around the original building and the superimposed story-adding frame structure, including shock absorber devices of the prior art, according to the invention.

FIG. 6 shows a third embodiment of the invention. The upper story-adding structure 1 is of frame structure, which is separated from the lower single-deck supporting frame structure 10, and is also through the prior art shock absorbing devices for buildings 8 superimposed upon the lower single-deck supporting frame structure 10.

The span length of the story-adding supporting girder depends on the width of the original building. Among girders of different span lengths there are two categories, namely, of normal span and of over-sized span. The so-called normal span means that the height/span ratio H/L is rational for use in relation with the story height. When the height/span ratio of girder 2 $H/L \leqq (\frac{1}{8} \sim 1/12)$, it is possible to employ linear uniform cross-section girders. On the other hand, according to the design, the story height minus girder height and minus the thickness of floor slab is the usable story height, for example, the story height 2.9M minus girder height 1M and minus the thickness of floor slab 0.12M and the thickness of ground, gets the actual useable height 1.76M. Obviously this usable height is not rational for use in the structure, but it cannot be increased by increasing the height of the story, because increasing the height of the story will make the story height different from the height of the story of the original building. In this case, it is suitable to use a non-uniform cross-section girder of over-sized span. The following is an analysis of the design and construction requirements of the two categories of girder of normal span and girder of over-sized span:

(1) Girder of normal span:

a. Using multi-deck frame superimposed type supporting girder:

In order to facilitate construction and maximally enhance structural integrity, the girder of the frame generally is a superimposed type girder made by twice casting. The so-called superimposed type girder is a girder, of which a part of its height is first precast, and on this part prefabricated floor plates are placed. After the completion of the installation of floor plates, the concrete of the upper part of the girder is then cast to reach the designed height. Thus, the integrity of connection between girders, plate beams and columns is enforced. The prefabricated girder may be of prestressed concretes and form a prestressed concrete superimposed girder with later cast concrete. For design of a superimposed girder, reference can be made to design material on superimposed girders of high storied buildings. The story-adding structure uses superimposed girders, in which the requirements of construction are great, for example, strong charging and hoisting capacity, spacious sites and convenient transportation, etc. For a limited condition, the superimposed girders can also be cast in site.

b. Using cast-in-site rectangular supporting girders:

When the condition of the foundation is good and the span length is not too long, it is possible to use a uniform rectangular girder as story-adding structure supporting girder, the internal force of the girder being calculated according to the method for calculating the frame structure.

Figure 9:
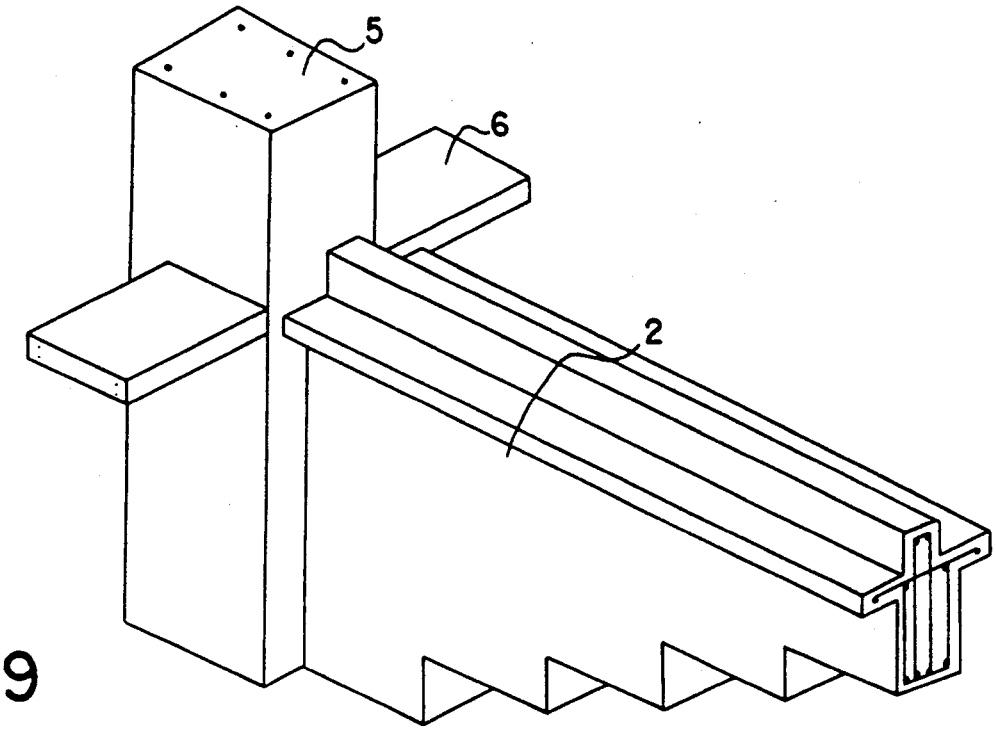
FIG. 9 is a three dimensional assembly drawing showing the long span, non-uniform cross-section girder and the plate beam and the story-adding supporting frame column.

(2) Girder of over-sized span:

When the span length of the story-adding structure is relatively long, it is because the height of the girder $H>(\frac{1}{8}\sim 1/12)$ L directly affects the usable height of the story structure, the uniform rectangular girder cannot be used and a non-uniform cross-section form should be adopted for the supporting girder. This is beneficial for load capacity and can reduce the sole weight of the structure and enlarge the usable space for the structure, as shown in FIG. 9.

Above the roof of the original building is the story-adding building. The load of every story of the story-adding building is transmitted through girder 2 to column 5. The original building is generally divided into a flat roof and a sloping roof. For a flat roof, hollow floor slabs of reinforced concrete are generally used, encouraging full use of it. A girth girder is cast in site on the flat roof to strengthen the overall load bearing capacity. Then the brick wall portion of the first floor of the story-adding building is laid on the girth girder, and the floor slabs are placed on the second floor girders Because there exists a relative displacement of the story-adding structure with respect to the original building, upon structural treatment, there is provided a clearance between the brick top surface of the story-adding first floor and the bottom surface of the plate beams and the second floor girder, so that the downward compression deformation of the story-adding structure before it is stable would not affect the original building. The clearance is filled with easily compressible material, such as foamed concrete bricks or air-entraining concrete bricks, etc.

When the original building comprises a building with a sloping roof, it is necessary to transform the roof into a flat roof by adopting a segmentation construction method so as to design and construct the story-adding structure in just the same way as that mentioned above with respect to the flat roofed old building. If the original building is a 5-storied building, it is necessary to remove the roof and a part of the upper part of the wall so as to reduce the slenderness ratio of the columns, to make the dimension of the cross-section of the column fit the appearance of the overall structure, and to leave spaces for the story-adding girder and the foamed concrete bricks. The lay-out of the story-adding structure is in principle the same as the original building, making a maximum use of the water supply and sewage system, stairways and electric circuits, etc, of the original building to minimize the difficulties of design and construction.

The nodal points of the story-adding structure must have adequate strength. It is necessary to make strength calculations for the construction stage as well as for the service stage. On calculating the strength, the first thing to do is to determine the internal force, i.e. the shearing force, moment and axial force at the nodal points, the direction of force transmission at the nodal points to analyze the various possible forms of failure of the nodal points, such as bending failure, cambering failure, shearing failure, nodal core failure, breakage f welded part or reinforcing bar, cambering of the main reinforcing bar, anchorage failure, and collapse of stirrups, etc. and then to decide the essential calculation formula and measures for construction.

The nodal points between the girders and the columns are generally the critical points of structural failure. Therefore in calculating the nodal strength, strengthening of the nodal points must be taken into consideration. In order to enhance the anti-shock capacity of the structure, the nodal points must have the necessary ductility.

Figure 12:
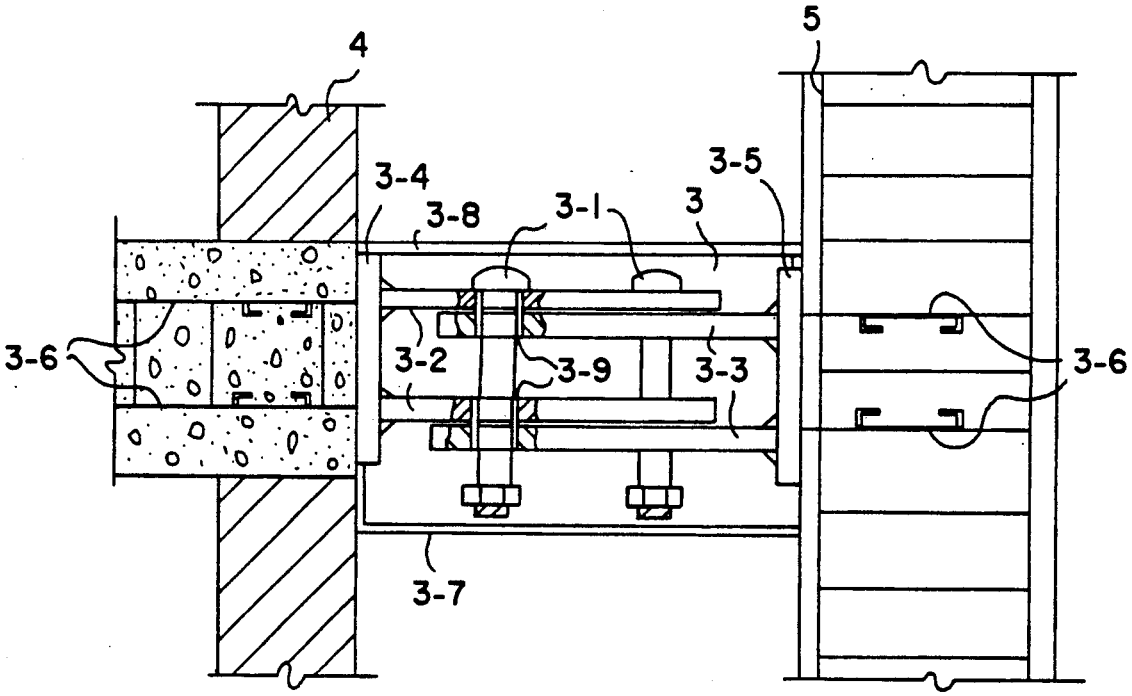
FIG. 12 shows an example of the connectors between new and old structures in raising the height of the old building, for connecting the new building with old building, as described in the prior art.

FIG. 12 shows an aspect of the prior art connections between new and old structures in raising the height of the old building, connecting the original building 4 with the story-adding structure column 5. It comprises a seal box formed of end stub plates 3-4, 3-5 and seal box plates 3-7, 3-8, connecting rings 3-2 rigidly connected with the left end stub plate 3-4, connecting rings 3-3 rigidly connected with the right end stub plate 3-5, and the bolts 3-1 connected with the connecting rings 3-2, 3-3 in oriented pivotal bearing connection, the parts 3-9 being the rubber linings. The left end stub plate 3-4 is anchored to the original building by means of the end stub anchoring reinforcing bars 3-6. The right end stub plate 3-5 is anchored by casting in situ to the story-adding structure column 5 by means of the end stub anchoring reinforcing bars 3-6. When the new building starts to sink, the connecting rings 3-3 will be displaced perpendicularly downward along the bolts 3-1 relative to the connecting rings 3-2. Since the distance between the upper connecting rigs 3-3 and the lower connecting rings 3-2 is greater than the amount of sinking of the new building, the sinking of the new building will not put any additional load on the original building 4.

I claim:

1. A method for adding stories to raise the height of original low-storied buidlings, comprising the steps laying a foundation closely around the original building, wherein upon said foundation story-adding supporting frame columns are erected, wherein structure expansion and contraction joints are provided between the original building and said columns, and wherein said joints are filled with compressible material;

rigidly connecting story-adding frame supporting girders with said frame columns above the roof of the original building so that the weight of said story-adding structure is to be supported by said girders and said frame columns to be transmitted to the ground base, wherein a clearance is provided between a bottom surface of said girders and a top surface of the original building, wherein the clearance should be bigger than an amount of sinking of said story-adding structure;

connecting said frame columns at a floor place of every story of the original building to the columns of the original building by means of a plurality of connectors, wherein one end of each frame column is fixed, while an end of the column at the original building has a vertically movable hinge, wherein sideways moving is not permitted;

providing an anti-sliding plate for ground base soil close to an outer side of said foundation of said story-adding supporting frame columns and below the bottom of said foundation; and providing a partition made of hard and thin material between the foundation of the original building and said foundation of said supporting frame columns.

2. A method for adding stories according to claim 1, wherein an upper story-added structure is added to the already formed lower single-deck supporting frame structure, and the two are made an integral structure.

3. A method for adding stories according to claim 1, wherein a composite upper story-adding structure is superimposed upon an already formed lower single-deck supporting frame structure through at least one shock absorbing device.

4. A method for adding stories according to claim 1, wherein a frame upper story-adding structure is superimposed upon an already formed low single-deck supporting frame structure through at least one shock absorbing device.

5. A method for adding stories according to any one of claims 1 to 4, wherein whenever said girders are of normal span and satisfy the relation $H \leqq (\frac{1}{8} \sim 1/12)L$, where H=height and L=length of said girders, uniform rectangular girders are used for said girders, and wherein whenever said girders are of over-sized span and satisfy the relation $H > (\frac{1}{8} \sim 1/12)L$ girders of non-uniform cross-section are used for said girders.

6. A method for adding stories according to any one of claims 1 to 4, wherein said supporting frame columns are lengthwise connected with each other by a plate beam at a floor level of every corresponding story of the original building.

7. A method for adding stories according to any one of claims 1 to 4, wherein when the original building has a sloping roof, a segmentation construction method is adopted to transform the roof into a flat roof, to reduce the height of said frame columns so that the construction of said upper story-added structure is facilitated.

8. A method for adding stories according to any one of claims 1 to 4, wherein the concreting of the foundation is conducted by way of a segmentation process.

9. A method for adding stories according to any one claim 1 to 4, wherein when story-adding construction is conducted in an area having a high underground water level, an under water concreting method is adopted to form the foundation for the new building.

10. A method for adding stories according to claim 1, wherein if the foundation of the original building is not a supporting foundation, a part of the foundation is removed and the foundation of the new building is laid close to an outer side of the old one, so that the span lengths of said girders are shortened.

11. A method for adding stories according to claim 1, wherein prior to the connection of the story-adding frame supporting girders to said frame columns, the roof and a part of an upper part of a wall of the original building are removed and spaces for said story-adding girders and foamed concrete bricks are left, so that the slenderness ratio of said columns can be reduced.

* * * * *